US006237252B1

(12) United States Patent
Cook

(10) Patent No.: US 6,237,252 B1
(45) Date of Patent: May 29, 2001

(54) BOOT WITH EASY-TO-USE UPPER CLOSURE

(76) Inventor: Gordon N. Cook, 780 Laird Blvd., Montreal, Quebec (CA), H3R 1Y6

( * ) Notice: Subject to any disclaimer, the term of this patent is extended or adjusted under 35 U.S.C. 154(b) by 0 days.

(21) Appl. No.: 09/465,551

(22) Filed: Dec. 16, 1999

(30) Foreign Application Priority Data

Jan. 4, 1999 (CA) ..... 2257737

(51) Int. Cl.[7] ..... A43C 11/00
(52) U.S. Cl. ..... 36/50.1; 24/115 H
(58) Field of Search ..... 36/50.1, 1.5, 2 R; 24/115 G, 115 H

(56) References Cited

U.S. PATENT DOCUMENTS

D. 101,977 * 11/1936 Zuckerman .
D. 388,941 * 1/1998 Schapiro et al. .
4,461,098 * 7/1984 Degelman .
4,506,417 3/1985 Hara .
4,809,447 * 3/1989 Pacanowsky et al. .
5,345,656 * 9/1994 Merritt .
5,365,641 * 11/1994 Watambe et al. .
5,566,474 * 10/1996 Leick et al. .
5,657,557 * 8/1997 Hull et al. .
5,697,128 12/1997 Peregrine .
5,791,021 * 8/1998 James .
5,884,419 * 3/1999 Davidowitz et al. .
5,966,841 * 10/1999 Barret .

* cited by examiner

*Primary Examiner*—Ted Kavanaugh
(74) *Attorney, Agent, or Firm*—Lynn S. Cassan

(57) ABSTRACT

In a boot comprising an upper portion and a lower portion the upper portion comprises a flexible draw cord extends within channel means provided within and around the upper periphery of the upper portion and exits the channel means through openings in the upper portion. A squeeze-type fastener holds the draw cord at a selected length of the cord adjacent the openings and outside of the upper portion and the draw cord is an endless loop outside of the channel means. A gripping means is affixed to the terminal end of the endless loop of the draw cord. The endless loop termination of the draw cord outside of the boot ensures that the cord is never able to unintentionally retract into channel means 100 and eliminates any need for tying cord ends so that the upper closure is effective for use by a child without assistance from an adult.

3 Claims, 2 Drawing Sheets

BOOT WITH EASY-TO-USE UPPER CLOSURE

FIELD OF THE INVENTION

The invention is in the field of footwear and, in particular, pertains to boots having uppers which are close-fitted to the wearer's leg after they are put on by means of an upper closure such as children's boots.

BACKGROUND

The upper portions of winter boots are intended to provide warmth to the lower leg above the ankle and prevent snow from entering the boot. Typically the top edge of the upper is drawn close to the leg of the wearer by means of a draw cord which is drawn and held by a bow or knot, sometimes with the assistance of a squeeze-type cord fastener, so that snow and cold air are prevented from entering the boot, and this is true of both children's and adult's boots. For example, a prior art boot which has been commonly sold to date is a design having an upper draw cord with two loose ends and a squeeze-type cord fastener through which the two ends of the cord are drawn and held in position by the fastener, with the free ends of the cord being tied together in a bow or knot to further secure them and stop them from dragging or getting caught on things.

However, in the case of children's boots in particular both the need to tie a draw cord and the need to ensure that the loose ends of the draw cord do not retract back through the cord fastener (in which case they have to be re-threaded) is inconvenient in that an adult's assistance is frequently required to close the uppers of such boots. Therefore, there is a need for an upper closure which is effective to secure the upper to the wearer's leg yet can be fully operated by a young child without need for the child to be able to tie a draw cord or re-thread a squeeze-type cord fastener.

SUMMARY OF THE INVENTION

In accordance with the invention there is provided a boot comprising an upper portion and a lower portion therebelow. The upper portion comprises a flexible draw cord extending within channel means provided within and around the upper periphery of the upper portion and exiting the channel means through openings in the upper portion. A squeeze-type fastener holds the draw cord at a selected length thereof adjacent the openings and outside of the upper portion. The draw cord is an endless loop outside of the channel means. A gripping means is affixed to the endless loop preferably at the terminal end thereof.

The draw cord is preferably comprised of elastic and the gripping means is preferably comprised of plastic and comprises a channel within each side thereof through which the draw cord extends so that the terminal end is held in an extended position away from the boot.

BRIEF DESCRIPTION OF THE DRAWINGS

The invention is described in detail below with reference to the following drawings which illustrate a preferred embodiment of the invention.

DETAILED DESCRIPTION OF A PREFERRED EMBODIMENT

Figure 1:
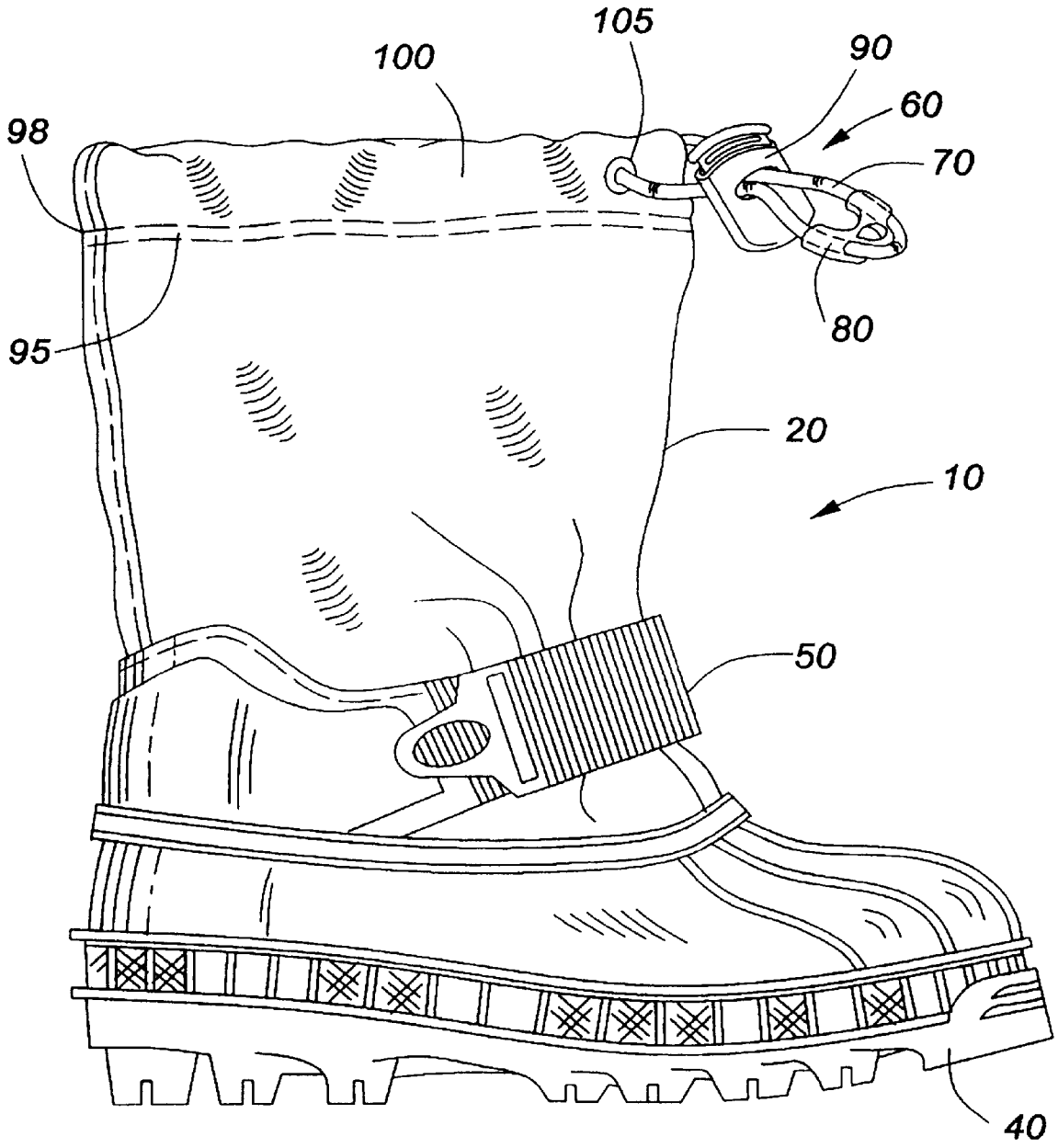
FIG. 1 is a side plan view of a boot comprising an upper closure in accordance with the invention; and, FIG. 2 is a detail view of the upper closure shown in FIG. 1.
Figure 2:
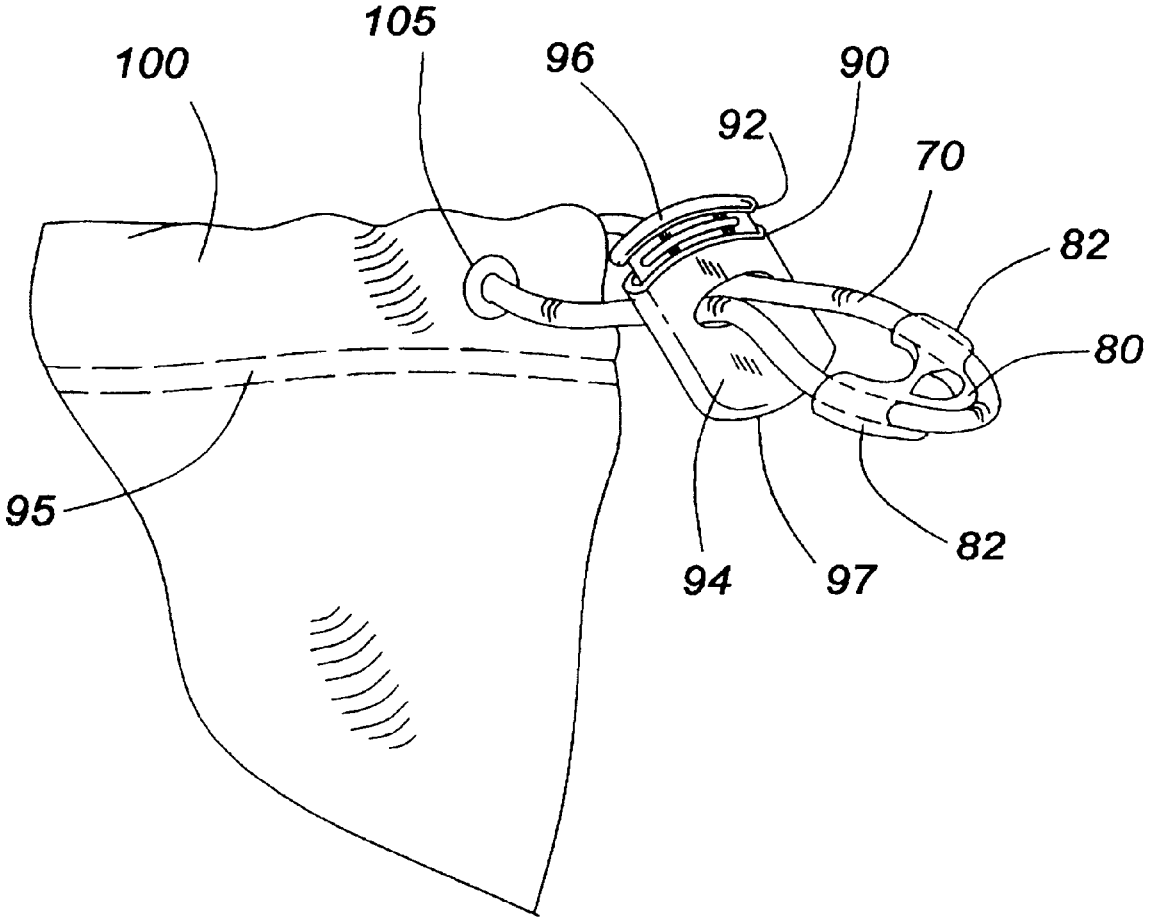

FIG. 1 of the drawings shows a side plan view of a boot 10 comprising an upper portion 20 and a lower portion 30 with a sole 40. A lower closure 50, which may be of any type such as a Velcro™ strap or zipper, is provided in the ankle area of the upper portion to secure the boot to the wearer's foot when it is worn. Within the upper periphery of the upper portion 20 there is channel means 100 for retaining a flexible draw cord 70. The channel means may be created by stitching through the material of the upper portion 20 a short distance from the top edge thereof as shown in the drawings by the seam lines 95. Openings 105 (one of these in the opposite side of the upper portion is not shown) are provided in channel means 100. Inside ends of the draw cord 70 are fixed within the channel means at the back of the boot 98 and then the draw cord extends through channel means 100 around the boot and out the openings 105 where it terminates in an endless loop as best shown by FIG. 2.

A squeeze-type fastener 90 holds the draw cord 70 at a selected length thereof outside of the channel means 100 and adjacent the openings 105. The fastener 90 comprises a spring-biased movable top component 92 and a bottom component 94 into which the top component moves when the top 96 and bottom 97 of the fastener 90 are squeezed together. The draw cord 70 is threaded through apertures (not shown) in the top and bottom components 92,94 which are aligned when the top component 92 is moved into the bottom component 94 but offset when the top component 92 is in its rest (i.e. spring biased) position such that the draw cord 70 is pinched and prevented from moving through the fastener until and unless the fastener components are squeezed together.

The draw cord 70 is preferably an elastic cord to provide to it substantial flexibility. The endless loop termination of the draw cord outside of the boot ensures that the cord is never able to unintentionally retract into channel means 100 and eliminates any need for tying cord ends. A gripping means 80, preferably comprised of plastic, is affixed to the terminal end of the endless loop of the draw cord outside of the boot so that the draw string can be readily gripped by a child wearing mitts. The gripping means 80 preferably comprises a channel 82 within each side thereof through which the draw cord extends so that the terminal end of the draw cord is held in an extended position away from the boot.

The foregoing details of the illustrated embodiment may be varied as considered expedient and are not to be considered essential to the invention by reason only of inclusion in the preferred embodiment. Rather the scope and definition of the invention is to be determined by the following appended claims.

What is claimed is:

1. A boot comprising an upper portion and a lower portion therebelow, said upper portion comprising a flexible draw cord extending within channel means provided within and around the upper periphery of said upper portion and exiting said channel means through openings in said upper portion and a squeeze-type fastener for holding said draw cord at a selected length thereof adjacent said openings and outside of said upper portion wherein said draw cord is a continuously uniform endless loop outside of said channel means and a gripping means is provided at the terminal end of said endless loop, said gripping means comprising a body section and a channel within each outer side thereof through which said draw cord extends whereby said terminal end of said endless loop is held in an extended position away from said boot and the draw cord sections at said terminal end are fixedly spaced apart.

2. A boot according to claim 1 wherein said draw cord is elastic.

3. A boot according to claim 2 wherein said gripping means plastic.

* * * * *